US008330030B1

(12) United States Patent
Wang

(10) Patent No.: US 8,330,030 B1
(45) Date of Patent: Dec. 11, 2012

(54) BODY OF DRUM AND DRUM INCLUDING THE SAME

(76) Inventor: Wei-Pin Wang, Taichung (TW)

( * ) Notice: Subject to any disclaimer, the term of this patent is extended or adjusted under 35 U.S.C. 154(b) by 0 days.

(21) Appl. No.: 13/344,750

(22) Filed: Jan. 6, 2012

(51) Int. Cl.
*G10D 13/02* (2006.01)

(52) U.S. Cl. ..... 84/411 R

(58) Field of Classification Search ..... 84/421, 84/411 R
See application file for complete search history.

(56) References Cited

U.S. PATENT DOCUMENTS 6,300,551 B1 * 10/2001 Adinolfi ..... 84/411 R

* cited by examiner

*Primary Examiner* — Kimberly Lockett

(57) ABSTRACT

The body of drum includes an outer body, an inner body, and two positioning loops. The outer and the inner bodies are both hollow rings but are made of different materials. Each positioning loop has a first face and an opposite second face. A convex rib protrudes on the center of the width of the first face and partitions the first face of the positioning loop to a ring-shaped inner fringe and a ring-shaped outer fringe. The fringes of the two opposite ends of the outer body are disposed on the two outer fringes respectively, and the fringes of the two opposite ends of the inner body are disposed on the two inner fringes respectively. The convex rib is located between the outer and the inner bodies. Thus, the timbre can be changed by making different combinations of the inner and the outer bodies.

8 Claims, 5 Drawing Sheets

BODY OF DRUM AND DRUM INCLUDING THE SAME

BACKGROUND OF THE INVENTION

1. Field of the Invention

The present invention relates to a body of drum.

2. Description of the Prior Art

A conventional drum has a single body of drum which is undetachable, so the timbre is constant. For example, the body of drum disclosed in TWM324833 is composed of a plurality of layers stacked tightly. But the layers are made of the same material, so the timbre of drum is still constant. When another timbre is needed, one can only replace the whole drum with another drum, and it is obvious that the replacement is not convenient and not economical. The timbre of drum is also adjustable with tuning devices, but the effect of adjustment is restricted.

Another body of drum disclosed in TWM325583 has a tuning loop to adjust the timbre. But the body of drum is still the same one, so the effect is still restricted.

In conclusion, the timbre of drum is only changed by replaced with another drum with the body made of another material. Otherwise, the timbre of the body made of single material is constant, and a user can not make combinations of bodies of drum made of different materials.

SUMMARY OF THE INVENTION

The main object of the present invention is to provide a body of drum and a drum having the same which are able to do exchangement of timbre.

To achieve the above and other objects, a body of drum of the present invention includes an outer body, an inner body, and two positioning loops. The outer and the inner bodies are both hollow rings and are made of different materials. An outer diameter of the inner body is smaller than an inner diameter of the outer body. Each positioning loop has a first face and an opposite second face, and a positioning portion is arranged on a width of the first face. More preferably, the positioning portion is a convex rib. The convex rib protrudes on a center of the width of the first face and surrounds the positioning loop. The convex rib partitions the first face of the positioning loop to a ring-shaped inner fringe and a ring-shaped outer fringe. A width of bottom of the convex rib is larger than a width of top of the convex rib, and a cross-section of the convex rib is trapezoid. Fringes of two opposite ends of the outer body are disposed on the two outer fringes respectively, and fringes of two opposite ends of the inner body are disposed on the two inner fringes respectively. In other words, the convex rib is located between the outer body and the inner body.

The drum having the body of drum mentioned above of the present invention also includes two drumheads, two drum hoops, and a plurality of fixing element. An area of each drum head is larger than a flat area of the positioning loop. The drumhead covers the second face of the positioning loop, and a fringe of the drumhead is located on the outside of the positioning loop. An inner diameter of the drumhead is not smaller than an outer diameter of the positioning loop. The drum hoop is disposed on the fringe of the drumhead, and the fringe of the drumhead is sandwiched between the drum hoop and the positioning loop. The fixing elements are used to connect and fix the drum hoop and the outer body together.

Thereby, the body of drum and the drum having the same have two separated bodies made of different materials respectively. Also, the two bodies are both detachable and exchangeable, so the timbre can be changed by combination of different bodies.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
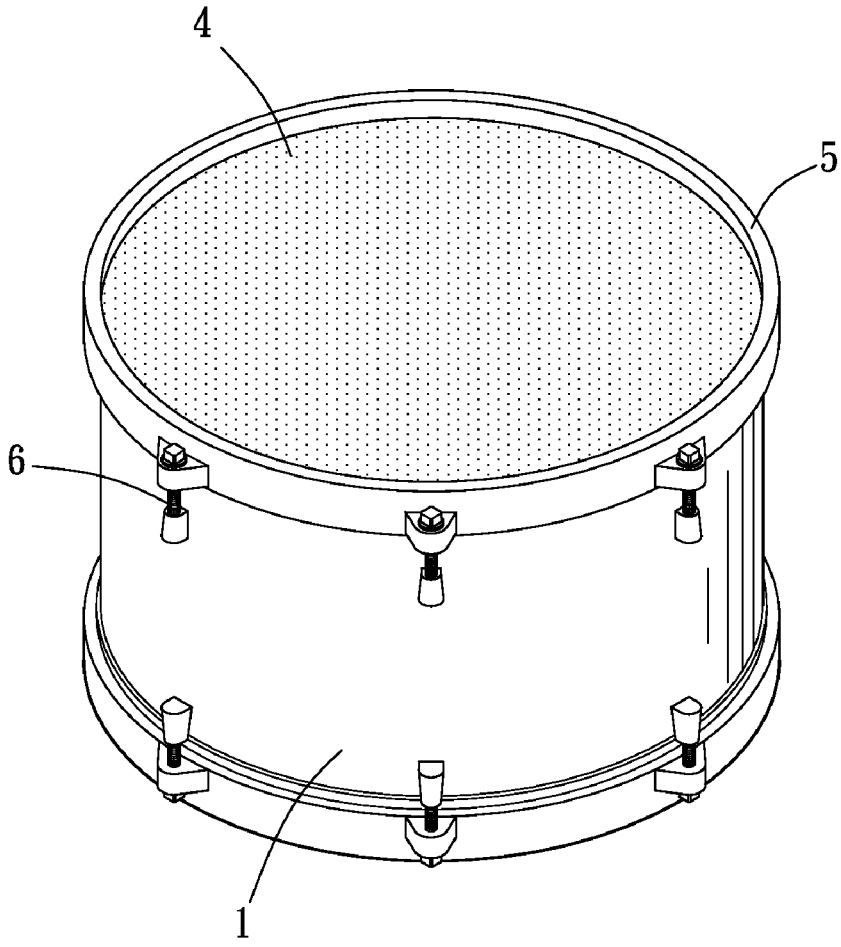
FIG. 1 is a stereogram showing a preferred embodiment of a body of drum and a drum having the same of the present invention.
Figure 2:
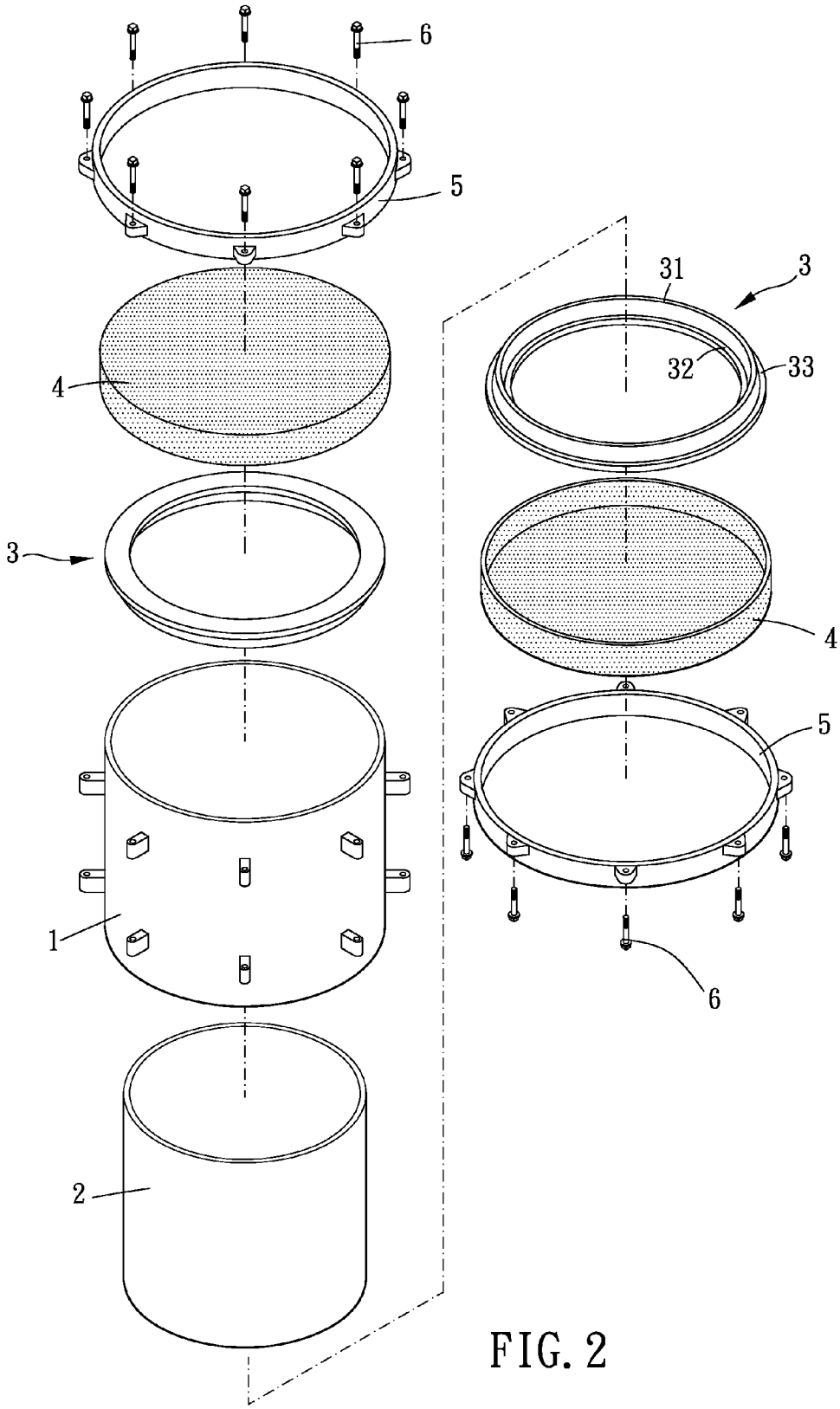
FIG. 2 is a breakdown drawing showing a preferred embodiment of a body of drum and a drum having the same of the present invention.
Figure 3:
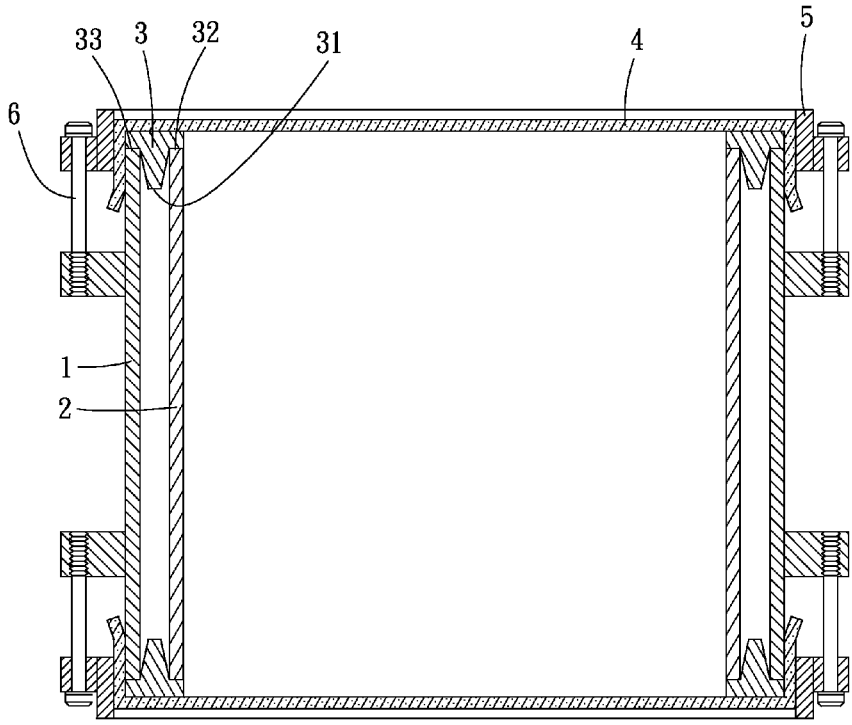
FIG. 3 is a cross-section views showing a preferred embodiment of a body of drum and a drum having the same of the present invention.

Please refer to FIG. 1 to FIG. 3, the body of drum of the present invention includes an outer body 1, an inner body 2, and two positioning loops 3.

The outer body 1 and the inner body 2 are both hollow rings and are made of different materials. An outer diameter of the inner body 2 is smaller than an inner diameter of the outer body 1.

Each positioning loop 3 has a first face and an opposite second face. A positioning portion is arranged on a width of the first face, and the positioning portion has an inner fringe 32 and an outer fringe 33. In the major embodiment of the present invention, the positioning portion is a convex rib 31 protruding on the center of the width of the first face and surrounding the positioning loop 3. The convex rib 31 partitions the first face of the positioning loop 3 to the inner fringe 32 and the outer fringe 33. A perimeter of the fringe of the outer body 1 is substantially the same with a perimeter of the outer fringe 33 of the positioning loop 3, a perimeter of the fringe of the inner body 2 is substantially the same with a perimeter of the inner fringe 32 of the positioning loop 3. Thus, the fringes of two opposite ends of the outer body 1 are disposed on the two outer fringes 33, and the fringes of two opposite ends of the inner body 2 are disposed on the two inner fringes 32. In other words, each convex rib 31 is located between the outer body 1 and the inner body 2. The most special is that a width of bottom of the convex rib 31 is larger than a width of top of the convex rib 31, so the cross-section of the convex rib 31 is trapezoid, as shown in FIG. 3. Due to the thinner top, a user can easily plug the convex rib 31 into the interstice between the outer body 1 and the inner body 2 and fix tightly. Besides, the width of bottom of the convex rib 31 is larger, so the outer body 1 and the inner body 2 can press against the outer fringe 33 and the inner fringe 32 tightly.

Referring to FIG. 1 to FIG. 3, the drum having the body of drum mentioned above also includes two drumheads 4, two drum hoops 5, and a plurality of fixing elements 6. An area of each drumhead 4 is larger than a flat area of the positioning loop 3. The drumhead 4 covers the second face of the positioning loop 3, and a fringe of the drumhead 4 is located on the outside of the positioning loop 3. An inner diameter of the drum hoop 5 is not smaller than an outer diameter of the positioning loop 3. The drum hoop 5 is disposed on the fringe of the drumhead 4, and the drumhead 4 is sandwiched between the drum hoop 5 and the positioning loop 3. Each fixing element 6 is used to connect and fix the drum hoop 5 and the outer body 1 together and to tension the drumhead 4. In other possible embodiment, the fixing elements 6 can have adjustment device to adjust the tension of the drumhead 4.

Since the outer body and the inner body are engaged together by only the positioning loop, the bodies can be replaced with the ones made of different materials at will. Furthermore, both the outer and the inner bodies can be replaced, so a user can obtain different timbre by making combination of body of drum made of different materials. For example, the drum with fiberglass outer body and metal inner body and the drum with metal outer body and fiberglass inner body have different timbre. Thus, the drum of the present invention provides a variety of timbre. Besides, the design of the convex rib enables detaching and exchanging more easily and rapidly. Also, the convex rib can separate the outer and the inner bodies apart to maintain the timbre stable.

Figure 4:
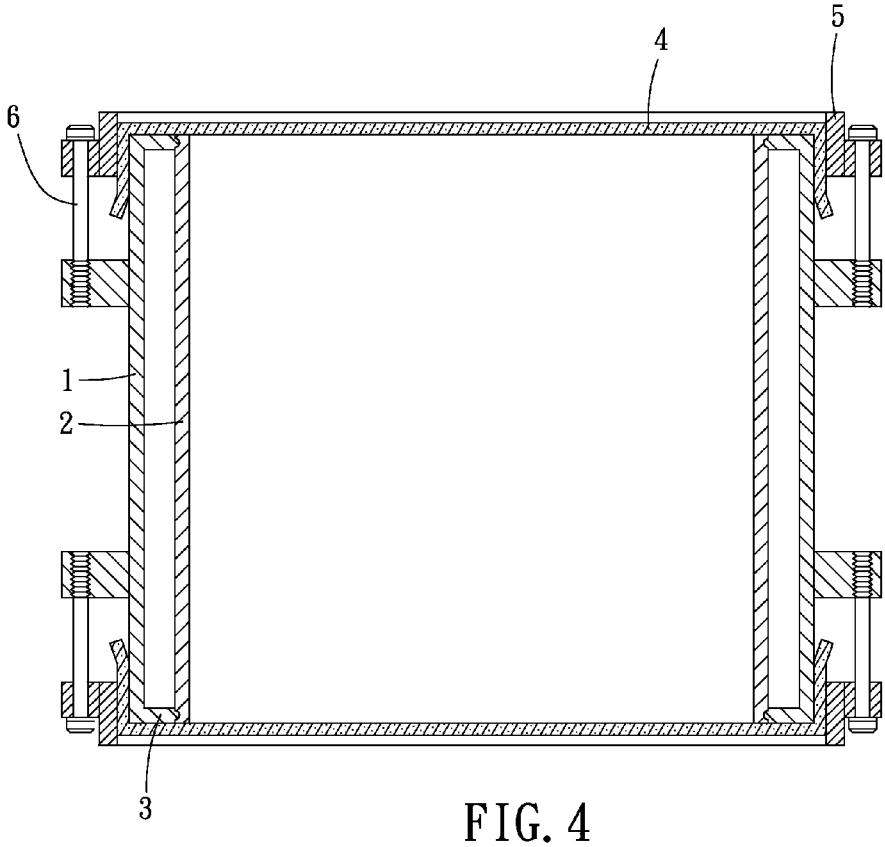
FIG. 4 is a cross-section view showing a second embodiment of a body of drum and a drum of the present invention.
Figure 4A:
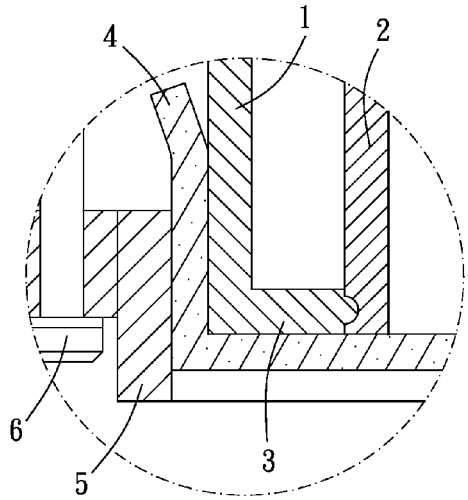
FIG. 4A is a partial enlargement view of FIG. 4.
Figure 5:
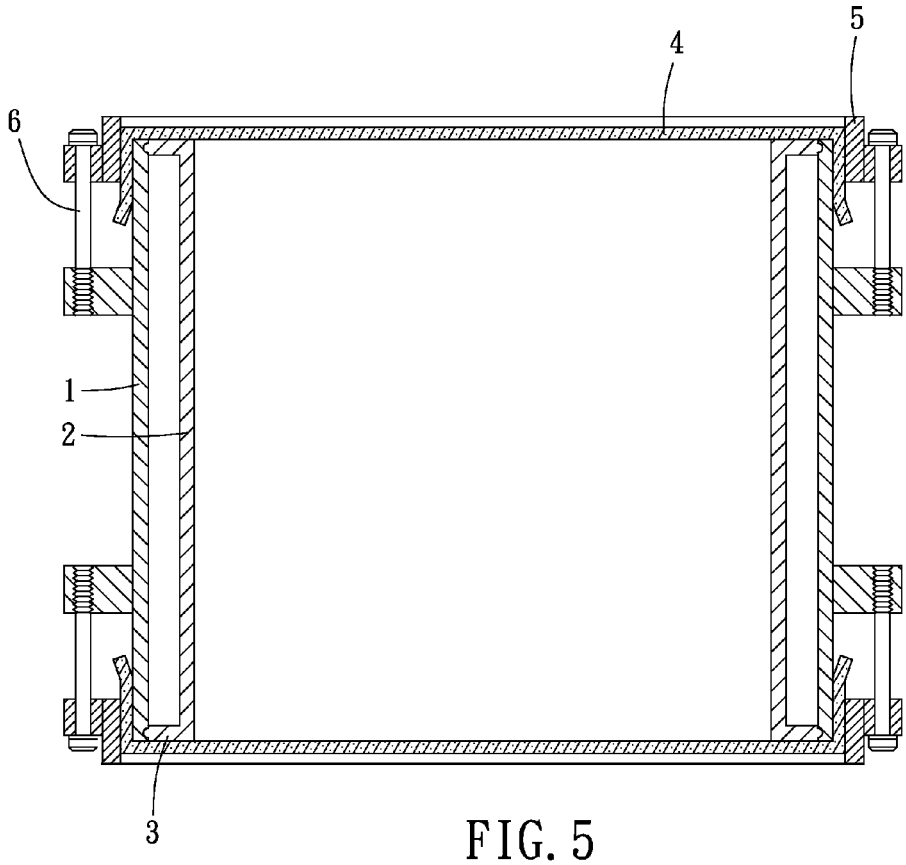
FIG. 5 is a cross-section view showing a third embodiment of a body of drum and a drum of the present invention.
Figure 5A:
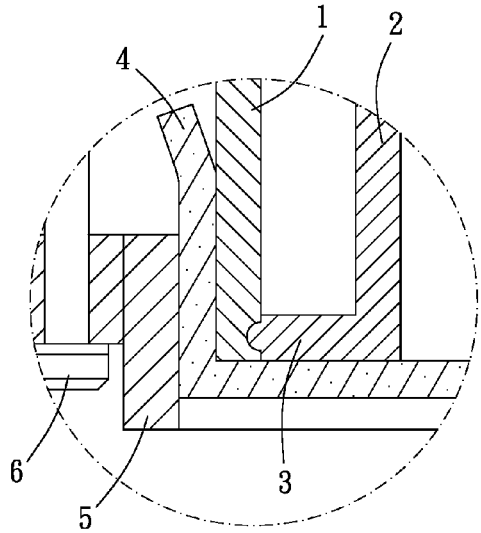
FIG. 5A is a partial enlargement view of FIG. 5.

Please refer to FIG. 4 and FIG. 4A, in other embodiment, each positioning loop 3 can be integral with the outer body 1. The positioning loop 3 has a protrusion to engage with the inner body 2, and the inner body 2 has a corresponding recess to fix to the protrusion, wherein the positions of the protrusion and the recess can be exchanged. Each positioning loop 3 can also be integral with the inner body 2 instead, as shown in FIG. 5 and FIG. 5A. The engagement construction is analogous to the one just mentioned.

In conclusion, the body of drum and the drum having the same of the present invention provide a variety of options of timbre and are easy to detach and exchange to be space-saving and more economical.

What is claimed is:

1. A body of drum, including:

an outer body, the outer body being a hollow ring;

and inner body, the inner body being a hollow ring, an outer diameter of the inner body is smaller than an inner diameter of the outer body, the outer body and the inner body being made of different materials;

two positioning loops, each positioning loop having a first face and a opposite second face, a positioning portion being arranged on a width of the first face, the positioning portion having a ring-shaped inner fringe and a ring-shaped outer fringe;

wherein fringes on two opposite sides of the outer body are disposed on the two outer fringes respectively, fringes on two opposite sides of the inner body are disposed on the two inner fringes respectively, the outer and the inner bodies are replaceable.

2. The body of drum of claim 1, wherein each positioning portion is a convex rib, the convex rib protrudes on a center of the width of the first face of the positioning loop and surrounds the positioning loop, the convex rib is located between the outer body and the inner body.

3. The body of drum of claim 2, wherein a width of a bottom of the convex rib is larger than a width of a top of the convex rib, a cross-section of the convex rib is trapezoid.

4. The body of drum of claim 1, wherein the positioning portion is integral with one of the outer body or the inner body.

5. A drum having the body of drum of claim 1, also including:

two drumheads, an area of each drumhead is larger than a flat area of the positioning loop, the drumhead covers the second face of the positioning loop, a fringe of the drumhead is located on an outside of the second face of the positioning loop;

two drum hoops, an inner diameter of each drum hoop is not smaller than an outer diameter of the positioning loop, the drum hoop is disposed on the fringe of the drumhead, the fringe of the drumhead is sandwiched between the drum hoop and the positioning loop;

a plurality of fixing elements, each fixing element connects and fixes the drum hoop and the outer body together.

6. The drum of claim 5, wherein each positioning portion is a convex rib, the convex rib is protruded on a center of the width of the first face of the positioning loop and surrounds the positioning loop, the convex rib is located between the outer body and the inner body.

7. The drum of claim 6, wherein a width of a bottom of the convex rib is larger than a width of a top of the convex rib, a cross-section of the convex rib is trapezoid.

8. The drum of claim 5, wherein the positioning portion is integral with one of the outer body or the inner body.

* * * * *